United States Patent [19]

Scherbing

[11] Patent Number: 4,662,198

[45] Date of Patent: May 5, 1987

[54] AXIAL SPLIT-PIN TUMBLER-TYPE LOCK MECHANISM FOR A POP-OUT LOCK

[75] Inventor: Frank J. Scherbing, Chicago, Ill.

[73] Assignee: Warrior Corporation, Foster-Bensenville, Ill.

[21] Appl. No.: 713,895

[22] Filed: Mar. 20, 1985

[51] Int. Cl.[4] ..... E05B 27/08

[52] U.S. Cl. ..... 70/363; 70/364 A; 70/375; 70/448

[58] Field of Search ..... 70/134, 351, 363, 373–374, 70/448, 449, 375; 403/341, 364, 380

[56] References Cited

U.S. PATENT DOCUMENTS

| | | | |
|---|---|---|---|
| 1,192,174 | 7/1916 | Dvorak | 403/364 |
| 2,061,354 | 11/1936 | Federholzner | 70/375 |
| 2,286,802 | 6/1942 | Herskind | 403/364 |
| 2,588,230 | 3/1952 | George | 70/363 |
| 3,524,335 | 8/1970 | George | 70/363 |
| 3,541,819 | 11/1970 | Kerr | 70/375 |
| 3,681,955 | 8/1972 | Sturgeon | 70/363 |
| 3,824,817 | 7/1974 | Orr | 70/134 |
| 4,083,211 | 4/1978 | Scherbing | 70/363 |

FOREIGN PATENT DOCUMENTS

| | | | |
|---|---|---|---|
| 705258 | 4/1966 | Italy | 70/363 |

*Primary Examiner*—Gary L. Smith
*Assistant Examiner*—Suzanne L. Dino
*Attorney, Agent, or Firm*—Leydig, Voit & Mayer

[57] ABSTRACT

An axial-split pin tumbler-like lock mechanism for a pop-out lock of the type including a lock cylinder, a forwardly disposed operating spindle part rotatable in the cylinder, a rearwardly disposed sleeve held stationary in the cylinder and adjoining the operating spindle part defining a transverse interfacial plane, the operating spindle part including a shaft extending axially through the stationary sleeve, key operated spring pressed axially movable split-pin tumblers carried in bores in the operating spindle part and the stationary sleeve part and movable into positions ultimately serving to secure the operating spindle part and the stationary sleeve part against relative rotation and to free the operating sleeve part for rotation to operate the lock mechanism with the insertion of the proper key, includes a bolt holder removeably attachable with the stationary sleeve part and disposed rearwardly thereof, the holder having a bolt race extending transversely therein, and a lock bolt mounted in the race for transverse sliding movement therein between unlocking and locking positions, the bolt having means cooperating with coupling means on the distal end of the shaft for moving the bolt between such positions in response to rotation of the spindle operating part, the bolt holder being provided with means for affixedly securing by pins to the lock cylinder with the cooperating attachment between the bolt holder and stationary sleeve part maintaining the stationary sleeve fixed when assembled in the lock cylinder.

6 Claims, 8 Drawing Figures

AXIAL SPLIT-PIN TUMBLER-TYPE LOCK MECHANISM FOR A POP-OUT LOCK

BACKGROUND OF THE INVENTION

The present invention relates generally to axial-split pin tumbler-like lock mechanisms of the "pop-out" type, which include a bolt holder forming part of the lock mechanism and a lock bolt mounted in the holder and adapted to project laterally outwardly from the lock for locking purposes.

A lock of the type of the present invention is disclosed in Scherbing U.S. Pat. No. 4,083,211 which is particularly suitable for use in handle locks of the type frequently employed on vending machine cabinets and the like. Such a lock, includes a tubular casing which receives the cylindrical body of a "pop-out" rotatable handle. The cylinder lock is mounted in the handle body, and it operates a lock bolt which projects laterally to secure the handle body to the cylinder casing. Operation of the cylinder lock by a proper key moves the lock bolt into a retracted unlocking position, which releases the handle, so that it pops out of the casing under spring pressure and may be turned for opening a cabinet door or the like.

In the aforesaid prior Scherbing U.S. Pat. No. 4,083,211 there is disclosed and claimed an arrangement where the bolt holder was formed integrally with the stationary sleeve such as by molding to reduce the number of parts and manufacturing operations, as well as to render assembly faster and more economical. While that arrangement of the aforementioned patent did overcome the problems associated with previous multiple part lock mechanisms employed in handle locks, there was no real versatility for optional features which could be included, such as by construction, it was limited to at most a seven-pin tumbler lock arrangement. In addition, by utilizing a one piece molded sleeve and bolt holder part, limitations as to the strength of the material used for the entire part necessitated by the bolt holder portion did not lend itself to solving sticking problems due to moisture formation and freezing under extremely cold conditions.

Finally, the use of the single large staking pin passing through the cylinder and into the sleeve inhibits the maximum number of pin tumblers and the large pin interferes with providing an arrangement for foiling use of lock pullers.

SUMMARY OF THE INVENTION

The general aim of the present invention is to provide a new and improved tubular lock mechanism for a pop-out lock in which the stationary sleeve is held within the cylinder in a novel manner which improves the versatility of the lock and enables variations of features including that of avoiding freezing and sticking of the lock.

Another object of the invention is to provide a bolt holder arrangement for a pop-out type lock mechanism which coacts to fix the stationary sleeve in the lock cylinder and enables use of an improved pinning arrangement for holding the assembly in the lock cylinder.

Still a further object of the present invention is to provide a tubular key lock of the foregoing type wherein relatively simple and inexpensive changeover of the stationary sleeve part at the time of assembly enables setting up either a 7 or 8-pin tumbler lock to maximize security against picking.

These and other advantages of the invention will become more apparent from the following detailed description when taken in conjunction with the accompanying drawings.

DETAILED DESCRIPTION OF THE PREFERRED EMBODIMENT

Figure 1:
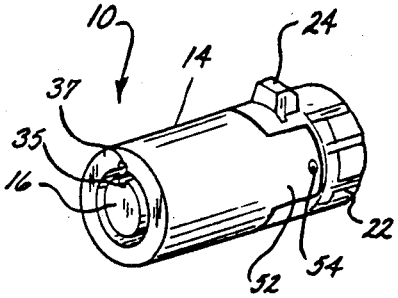
FIG. 1 is a front prospective view of a tubular key lock mechanism, in accordance with the invention.

Turning to the drawings, there is illustrated in FIG. 1, an axial-split pin tumbler-type lock mechanism 10 which is particularly adapted for use in a pop-type or handle lock structure (not shown). A lock arrangement of this type, to be operated by a typical tubular key 12 (FIG. 3) is illustrated, for example, in Scherbing U.S. Pat. No. 4,083,211.

Figure 3:
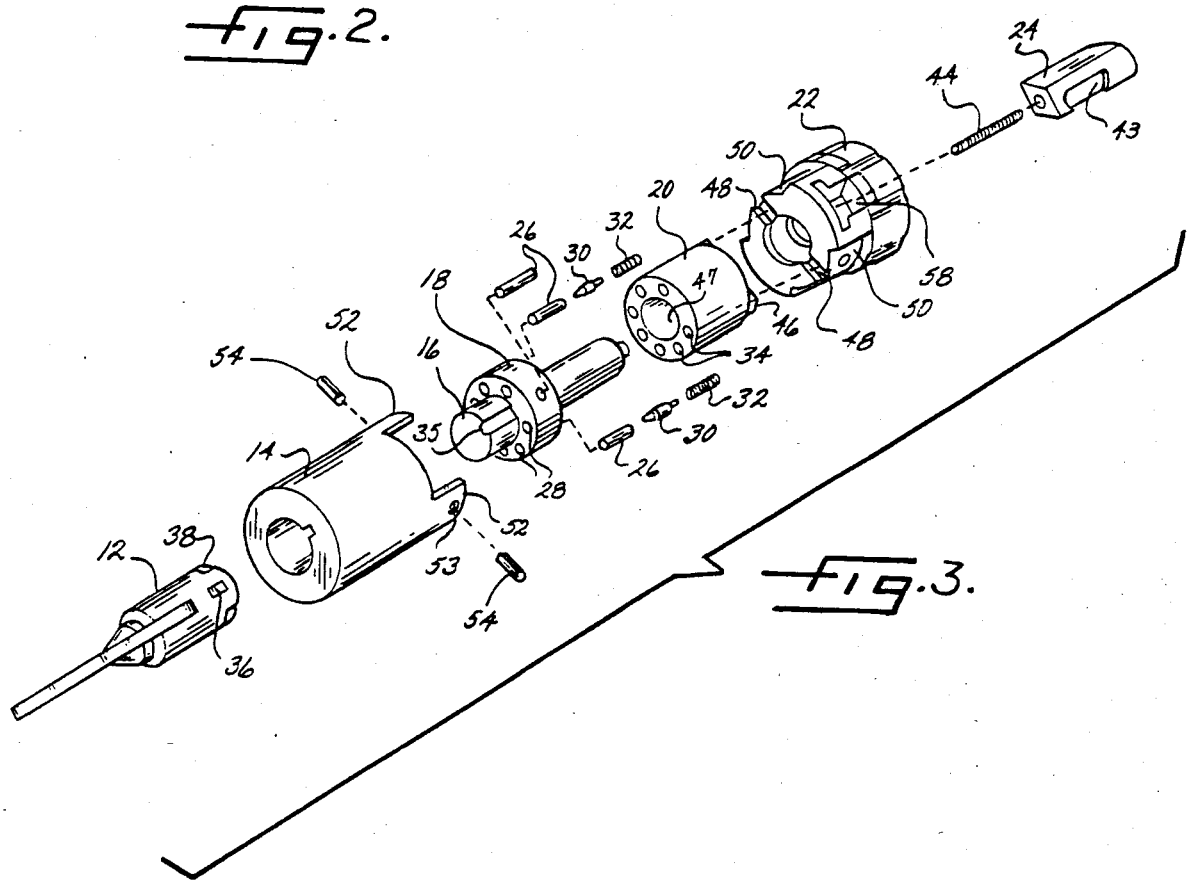
FIG. 3 is an exploded perspective view of the tubular key lock mechanism and key.

As shown by reference to FIGS. 1 and 3, conjointly, the lock mechanism 10 is made up of an outer cylinder or casing 14, an operating spindle 16 which carries a spindle sleeve 18, a stationary tumbler sleeve 20 and bolt holder 22 that contains transversely slidable lock bolt 24.

Figure 2:
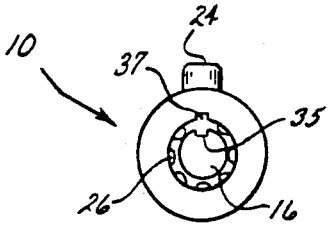
FIG. 2 is a front end elevational view of the lock mechanism of FIG. 1.

The general arrangement of the lock mechanism is that of a conventional axial-split pin tumbler-type lock wherein a plurality of driver or combination pins 26 carried in bores 28 of the spindle sleeve 18 cooperate with follower pins 30 which are normally driven forward by tumbler coil springs 32 contained in bores 34 of the stationary sleeve 20. In the embodiment of FIGS. 1–3, the arrangement is for seven sets of tumblers, only two of which are illustrated in FIG. 3.

When the lock mechanism is assembled as shown in FIG. 1, and a proper key 12 is inserted into the lock circular key opening with the key guide 36 lining up with the casing notch 37, coded key notches 38 shift the coded driver pins 26 rearwardly lining up the innerface between the tumbler pins at the shear plane defined between the spindle sleeve 18 and the stationary sleeve 20 allowing the spindle to be rotated by the key 12.

When the spindle is rotated by the key 12 operating on drive notch 35, the rearwardly directed shaft end 40, which carries a reduced diameter pin 42 at its rearmost end, coacts with a groove 43 formed in bolt 24 so that the bolt is moved radially inwardly against compression spring 44 which normally serves to hold bolt 24 in an outwardly projecting position. As will be appreciated by those skilled in the art, the bolt 24 is mounted so as to be normally urged outwardly by compression spring 44 when the lock is in the locked position, although the bolt can be cammed inwardly by a surrounding casing such as in a handle lock until the bolt is received in a locking slot of the casing where it then springs outwardly to hold the lock mechanism. When unlocked by a proper key which retracts the bolt 24, in a pop-out type lock, a spring (not shown) normally compressed behind the bolt holder 22 would allow the mechanism 10 to move forward until the bolt 24 seats in a secondary slot to render a handle or the like operable.

In accordance with the present invention, the stationary sleeve 20 is provided with corresponding coupling means for removable engagement with the bolt holder 22 which in turn is provided with complementary corresponding means for staking the lock cylinder to the bolt holder. The arrangement is such that the stationary sleeve becomes fixedly held when assembled together with the bolt holder 22 and casing 14. The present structure and arrangement provides a number of benefits and advantages over the prior one piece molded sleeve and bolt holder construction of Scherbing U.S. Pat. No. 4,083,211.

To this end, referring to FIG. 3, the stationary sleeve 20 includes a pair of rearwardly projecting lugs 46 disposed on opposite sides of the central opening 47 which receives shaft 40 of the spindle 16. The lugs engage with and are received by slots 48 located on the forwardmost face of the bolt holder member 22. A pair of grooves 50 disposed on opposite sides of the peripheral wall of bolt holder 22 receive projecting ears 52 of casing 14 and a pair of roll pins 54 passing through openings 53 in respective ears serve to secure the casing 14 to the bolt holder 22. It should be appreciated that while the ears 52 and bolt holder grooves 50 are illustrated to be identical in arc length, one of the ears and corresponding grooves may be made smaller than the other to provide a fixed orientation for assembly where the key guide slot 37 will always be aligned on the same side as the bolt 24, as illustrated in FIG. 1.

Figure 8:
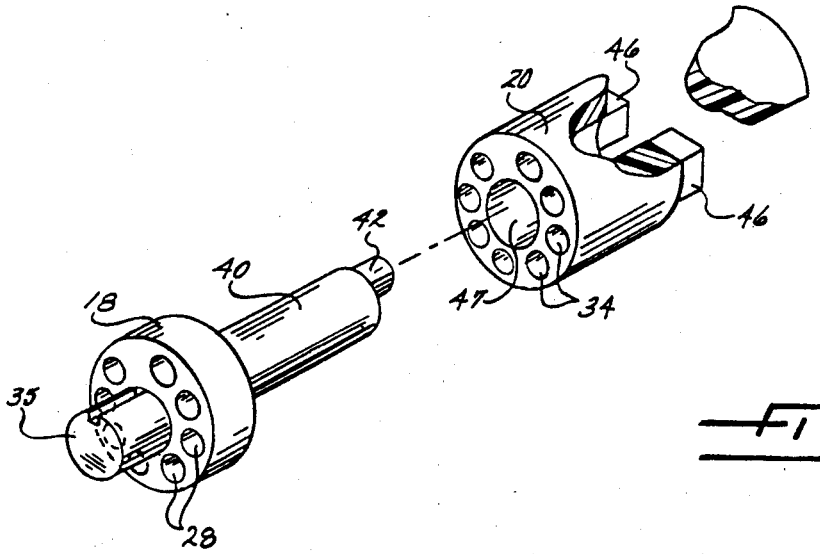
FIG. 8 is a partial exploded perspective view of the lock mechanism as in FIG. 3, here showing an eight pin tumbler lock arrangement utilizing a changed stationary sleeve part.

With the present arrangement when assembled, the stationary sleeve 20 becomes fixed by the engagement of lugs 46 with slots 48 when the casing ears 52 are firmly pinned in the grooves 50 of bolt holder 22. Also, with the present arrangement, the previously utilized single large staking pin that passed through the casing and the stationary sleeve has been eliminated so that the stationary sleeve now has the ability to accommodate another set of tumbler pins. This enables the providing of an eight pin tumbler lock by selectively changing the sleeve member 20 to one which has the appropriately located eight bores instead of seven bores 34 as shown in FIG. 8.

Figure 4:
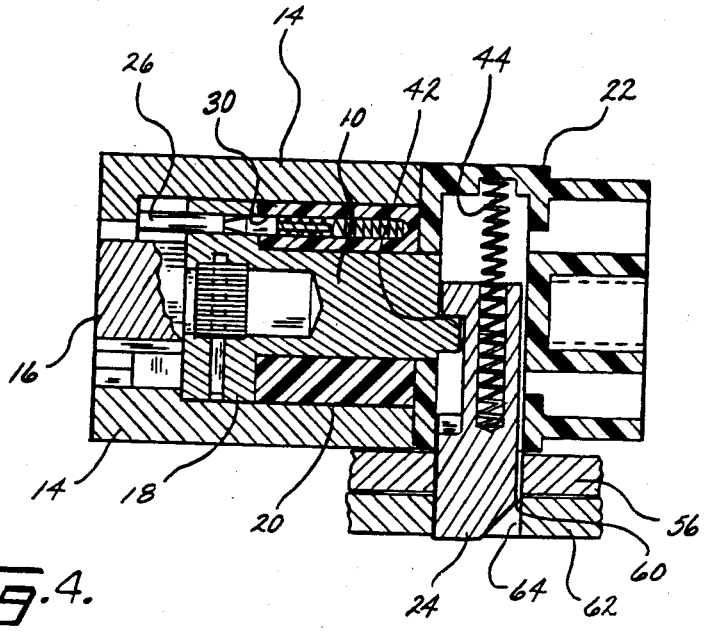
FIG. 4 is an enlarged longitudinal sectional view of the lock mechanism, shown with the lock bolt thereof in locking engagement with adjacent portions of a casing mount.
Figure 5:
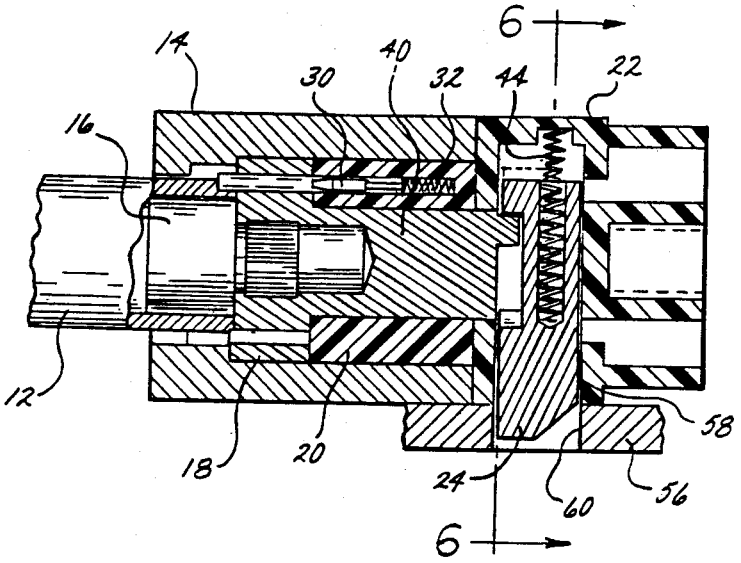
FIG. 5 is a view similar to FIG. 4, but illustrating a portion of the key of FIG. 3 engaging the lock tumblers to free the spindle operating part of the mechanism for rotation, and with the operating part rotated to place the lock bolt in an unlocking position.
Figure 6:
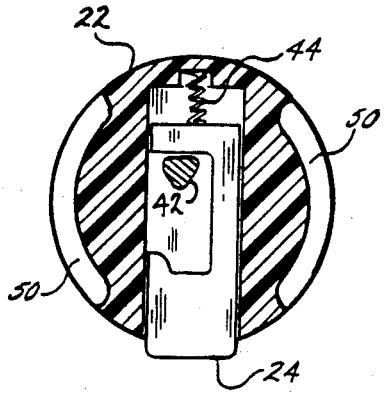
FIG. 6 is a transverse sectional view of the lock mechanism, taken substantially in the lines 6—6 of FIG. 5.
Figure 7:
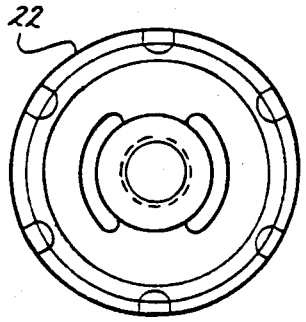
FIG. 7 is a rear end elevational view of the lock bolt holder.

As illustrated in FIGS. 4 and 5, the lock mechanism is arranged to be mounted in the tubular body 56, only a wall portion of which is illustrated in the Figures. The adjoining flush cylindrical surfaces on the lock cylinder body 14 and holder 22 fit snugly in the tubular body 56, and the bolt race 58 is aligned or registers with a corresponding opening 60 in the body. In the case of where the body 56 is a handle, there is usually an outer tubular casing 62 (FIG. 4) which receives the handle body and has a corresponding opening 64 to receive the bolt 24 for locking the handle body to the outer handle casing. When the key operation of the lock mechanism retracts the bolt 24 free from the opening 64 of the outer casing 60, the handle body 56 is free to move with the lock mechanism such as illustrated in FIG. 5.

In accordance with another aspect of the present invention, the bolt holder 22 which is preferably constructed by molding using a hard plastic composition, such as nylon filled with glass fibers, provides the necessary strength and integrity for carrying the bolt and assembly with the lock casing 14, while the sleeve 20 may be molded from a different material, such as a high density polyethylene or nylon alone. The material for the stationary sleeve part, thus, can be selected to provide easier and better rotation by the spindle sleeve at the shear plane or interface especially under cold operating conditions where freezing moisture condensation would ordinarily cause the lock to stick.

While preferred embodiments in the invention have been illustrated and described and reference has been made to certain changes and modifications which may be made in the embodiments, it will be apparent that further changes and modifications may be made therein within the spirit and scope of the invention. It is intended that all such changes and modifications be included within the scope of the appended claims.

I claim as my invention:

1. In a tubular key lock mechanism, having a lock cylinder, a forwardly disposed spindle operating part secured within said cylinder and rotatable about a longitudinal axis extending between front and rear ends thereof, a rearwardly disposed stationary sleeve within said cylinder and adjoining the operating part at a transverse interfacial plane, said spindle operating part including a rearwardly extending shaft passing axially through said stationary sleeve having coupling means on the end of the shaft, the spindle sleeve and stationary sleeve each having a plurality of longitudinal tumbler bores and carrying axially movable axial-split pin tumblers in said bores, the improvement comprising, a bolt holder adapted to be fixedly attached to the lock cylinder through means comprising at least one projecting ear on the lock cylinder and a corresponding groove formed in the bolt holder adapted to be held together by pin means, said holder disposed rearwardly of said cylinder and also adapted to be detachably engaged with said stationary sleeve and having a bolt race extending transversely therein, a lock bolt mounted in said race for transverse sliding movement between a retracted unlocking position and an extended locking position wherein the bolt projects laterally outward from the holder, said bolt having means cooperating with said spindle shaft coupling means for moving the bolt between its said positions in response to rotation of said spindle operating part, and coupling means provided on said stationary sleeve and on said bolt holder, said means adapted to cooperate interfittingly for fixedly joining and holding the stationary sleeve when the bolt holder is attached to the lock cylinder.

2. A lock mechanism as claimed in claim 1 wherein said coupling means between a stationary sleeve and said bolt holder are lugs projecting from the stationary sleeve and slots formed in the bolt holder, respectively.

3. A lock mechanism as claimed in claim 1 wherein said bolt holder and lock cylinder attaching means comprises a pair of projecting ears on the lock cylinder and a pair of corresponding grooves formed in the bolt holder adapted to be held together by pins.

4. A lock mechanism as claimed in claim 3 wherein one of said ears and corresponding groove are differentially sized from that of the other projecting ear and corresponding groove.

5. A lock mechanism as claimed in claim 1 wherein said stationary sleeve and bolt holder are each molded plastic parts formed by molding from different plastic materials.

6. In a tubular key lock mechanism, having a lock cylinder, a forwardly disposed spindle operating part secured within said cylinder and rotatable about a longitudinal axis extending between front and rear ends thereof, a rearwardly disposed stationary sleeve within said cylinder and adjoining the operating part at a transverse interfacial plane, said spindle operating part including a rearwardly extending shaft passing axially through said stationary sleeve having coupling means on the end of the shaft, the spindle sleeve and stationary sleeve each having a plurality of longitudinal tumbler bores and carrying axially movable axial-split pin tumblers in said bores, the improvement comprising, a bolt holder adapted to be fixedly attached to the lock cylinder through means comprising a pair of projecting ears on the lock cylinder and a pair of corresponding grooves formed in the bolt holder adapted to be held together by pins, one of said ears and corresponding groove being differentially sized from that of the other projecting ear and corresponding groove, said holder disposed rearwardly of said cylinder and having a bolt race extending transversely therein, a lock bolt mounted in said race for transverse sliding movement between a retracted unlocking positioin and an extended locking position wherein the bolt projects laterally outward from the holder, said bolt having means cooperating with said spindle shaft coupling means for moving the bolt between its said positions in response to rotation of said spindle operating part, and cooperating interfitting coupling means between said stationary sleeve and said bolt holder for fixedly joining and holding the stationary sleeve when the bolt holder is attached to the lock cylinder.

* * * * *